United States Patent [19]

Belin

[11] 4,351,166

[45] Sep. 28, 1982

[54] RING

[76] Inventor: Juliette Belin, 9040 Ft. Hamilton Pkwy., Brooklyn, N.Y. 11209

[21] Appl. No.: 205,841

[22] Filed: Nov. 10, 1980

[51] Int. Cl.[3] ..... A44C 9/00

[52] U.S. Cl. ..... 63/15; 63/5 R

[58] Field of Search ..... 63/15.45, 15.5, 5 R, 63/5 A, 3

[56] References Cited

U.S. PATENT DOCUMENTS

| | | | |
|---|---|---|---|
| 575,604 | 1/1897 | Hendrickson . | |
| 581,549 | 4/1897 | Goetz . | |
| 784,823 | 3/1905 | Whitsett | 63/15.45 X |
| 1,087,015 | 2/1914 | Heylmun . | |
| 1,130,917 | 3/1915 | Meyer . | |
| 2,109,609 | 3/1938 | Aull | 63/15.5 |
| 2,281,108 | 4/1942 | Montmartin | 63/5 R X |
| 2,806,363 | 9/1957 | Manne | 63/15.45 |

FOREIGN PATENT DOCUMENTS

| | | | |
|---|---|---|---|
| 768522 | 5/1934 | France | 63/3 |
| 236866 | 7/1925 | United Kingdom | 63/3 |

*Primary Examiner*—F. Barry Shay

*Attorney, Agent, or Firm*—Sprung, Horn, Kramer & Woods

[57] ABSTRACT

A ring (FIG. 3) composed of beads on an elastic string. The beads are disposed along the entire circumference of the ring when the ring is not on the finger. The ring can be a reminder ring.

4 Claims, 5 Drawing Figures

RING

BACKGROUND

This invention provides a ring which can serve as a reminder ring, and, while effective for that purpose, is at the same time inexpensive, aesthetically appealing, and provides other advantages as are explained hereinafter.

I am aware of various existing designs for reminder rings, and in particular those of Hendrickson, U.S. Pat. No. 575,604 of 1897, Goetz, U.S. Pat. No. 581,549 of 1897, Whitsett, U.S. Pat. No. 784,823 of 1905, Heylmun, U.S. Pat. No. 1,087,015 of 1914, and Meyer, U.S. Pat. No. 1,130,917 of 1915. I believe my ring to be superior to those proposals in respect to cost, functionality and appearance, inter alia.

THE INVENTION

My ring comprises an elastic string which is a closed circular loop on which beads are strung. The beads are disposed along substantially the entire circumference of the loop when the ring is off the finger and the elastic string is in the contracted condition, and the loop is a size such that the ring can be conveniently slipped onto the finger. When in place on the finger, the elastic is extended so that the ring grips the finger and tends to remain in place thereon. The annular width of the ring and the number of beads can be such that at all circumferentially spaced positions of the ring on the finger, upon lateral closing of the fingers the wearer will feel the ring and be thereby made conscious of the presence of the ring on the finger.

The Whitsell patent, op. cit., discloses a reminder ring having an elastic band.

EMBODIMENTS

The invention is illustrated in the accompanying drawings, of which:

Figure 1:
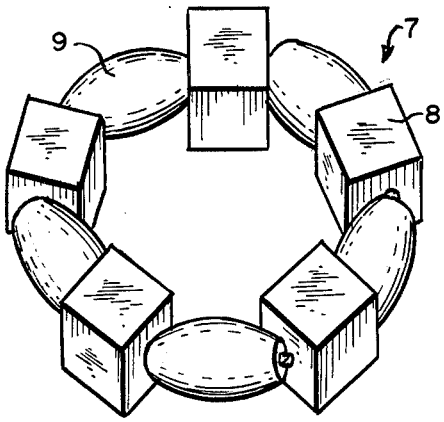
FIG. 1 is a ring according to the invention.
Figure 2:
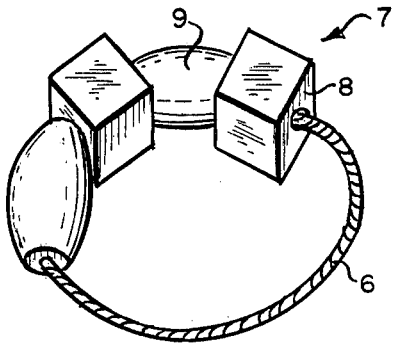
FIG. 2 shows the same ring with a portion of the beads removed.
Figure 3:
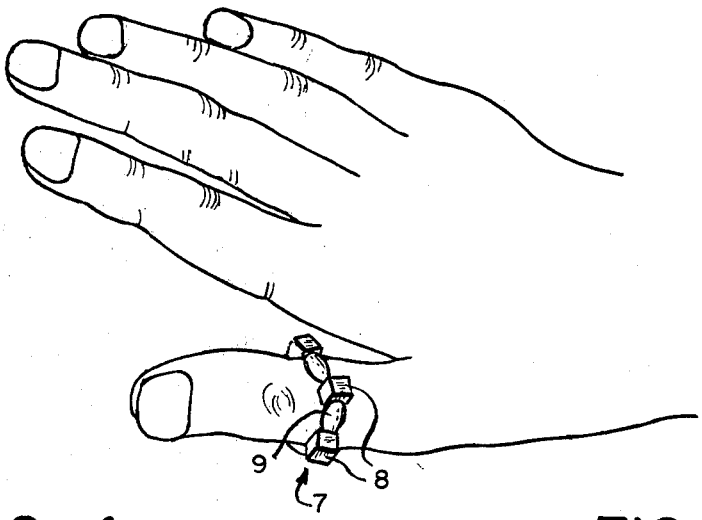
FIG. 3 shows the ring of FIG. 1 in place on a finger.

Referring to the drawings, the ring comprises an elastic string 6 which is a closed circular loop, having beads 7 strung thereon. The beads can be of different shapes, such as cubes 8 and football-like forms 9, the latter being of generally ellipsoidal shape. The beads can also be of different colors. Also, various designs can be employed for different rings so that different rings can be used for different reminder functions, e.g., a green ring could be a reminder to go to the bank, while a red ring could be a reminder to go to the grocery store, etc.

As is indicated in FIG. 1, the beads are disposed along substantially the entire ciurcumference of the loop formed by the string 6 when the ring is off the finger and the elastic string is in the contracted condition. Also, as explained above, the loop is of a size such that the ring can be conveniently slipped on and off, and, when in place on the finger, the elastic is extended so that the ring grips the finger and tends to remain in place thereon. Further, the annular width of the ring, as determined, for example, by the dimensions of the cubes 8, and the number of beads can be such that at all circumferentially spaced positions of the ring on the finger, upon lateral closing of the fingers, the wearer will feel the ring and be thereby made conscious of the presence of the ring on the finger. Thereby the reminder function will be secured.

The ring can be placed on any finger. For the reminder function it is well to place it on the thumb, where it will be easily seen.

Figure 4:
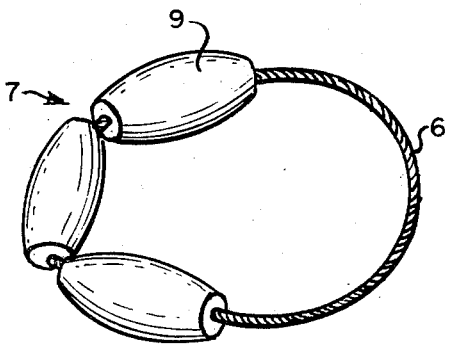
FIGS. 4 and 5 depict alternative embodiments.

Another feature is that when the ring is on a finger other than the thumb, especially, the index finger or the middle finger, it can be moved around the finger with the thumb. Thus, the ring can be "pumped" around the finger on which it is worn. It can also be slipped axially, forward and back, on the finger, especially while being pumped with the thumb. The ring can also be moved circumferentially and axially when on the thumb, using the fingers of the other hand to so move the ring. Such movements serve for fidgeting or the release of so-called nervous energy. For those purposes, all the beads can be spherical or at least have rounded surfaces or corners so that the beads slide easily in the circumferential direction over the skin of the finger without jerking, when pumped circumferentially by the thumb. The beads having rounded surfaces are preferably ellipsoidal with the axes thereof disposed circumferentially, as is shown in FIG. 4. They can, however, be cubes having rounded corners, or rectangular solids having rounded corners.

Figure 5:
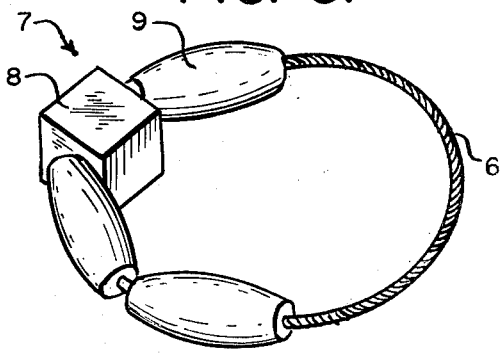

In this last-mentioned embodiment, the beads can all be of generally ellipsoidal shape. One of the beads can differ as shown in FIG. 5, so that the different bead will serve as a reminder function. The different bead can be such that upon moving it by pumping, jerking occurs. A cubical bead will cause jerking, as will also other shapes having square corners which will engage the skin when the bead is moved circumferentially.

As for dimensional specifics, the mean or average or middle diameter of the ring can be about $\frac{3}{4}$–$1\frac{1}{4}$0 inches, preferably about $\frac{7}{8}$–$1\frac{1}{8}$ inches, with about 1 inch working very well, while the corresponding annular widths are about $\frac{1}{8}$–$\frac{3}{8}$ inch, preferably about 3/16–5/16 inch with about 3/16 inch working very well.

What is claimed is:

1. A finger ring comprising an elastic string which is a closed, circular loop, beads strung on the string so that the beads are disposed along substantially the entire circumference of the loop when the ring is off the finger and the elastic string is in the contracted condition, the loop being of a size such that the ring can be conveniently slipped onto the finger and when in place on the finger the elastic will be extended so that the ring grips the finger and tends to remain in place thereon, wherein at least some of the beads have rounded surfaces so that when the ring is in place on the finger other than the thumb, it will slide circumferentially without jerking when beads having said rounded surfaces are pumped circumferentially with the thumb and wherein one of the beads includes means for causing jerking to occur when said one bead is pumped, said means including square corners on said one bead projecting radially inward and outward of the ring beyond the peripheries of the beads adjacent to said one bead, thereby to engage the skin when said one bead is moved circumferentially.

2. A finger ring according to claim 1, wherein the beads having said rounded surfaces are generally ellipsoidal with the axes thereof disposed circumferentially.

3. A finger ring according to claim 1, wherein the beads other than said one of the beads have said rounded surfaces.

4. A finger ring according to claim 1, 2, or 3, wherein the annular width of the ring and the number of beads are such that at all circumferentially spaced positions of the ring on the finger, upon lateral closing of the fingers the wearer will feel the ring and be thereby made conscious of the presence of the ring on the finger.

* * * * *